US006014111A

United States Patent [19]

Johannessen

[11] Patent Number: 6,014,111

[45] Date of Patent: Jan. 11, 2000

[54] FERRITE CROSSED-LOOP ANTENNA OF OPTIMAL GEOMETRY AND CONSTRUCTION AND METHOD OF FORMING SAME

[75] Inventor: Paul R. Johannessen, Lexington, Mass.

[73] Assignee: Megapulse, Inc., Bedford, Mass.

[21] Appl. No.: 08/870,089

[22] Filed: Jun. 5, 1997

[51] Int. Cl.[7] ..... H01Q 7/08

[52] U.S. Cl. ..... 343/788; 343/748; 343/787

[58] Field of Search ..... 343/788, 748, 343/787; H01Q 7/08

[56] References Cited

U.S. PATENT DOCUMENTS

| | | | |
|---|---|---|---|
| 3,495,264 | 2/1970 | Spears | 343/788 |
| 4,290,070 | 9/1981 | Tanaka et al. | 343/788 |
| 4,363,137 | 12/1982 | Salisbury | 455/40 |
| 5,220,339 | 6/1993 | Matsushita | 343/788 |
| 5,633,649 | 5/1997 | Grossi et al. | 343/788 |
| 5,645,774 | 7/1997 | Reczek et al. | 264/40 |
| 5,815,060 | 9/1998 | Matsumoto et al. | 336/175 |

*Primary Examiner*—Don Wong
*Assistant Examiner*—Hoang Nguyen
*Attorney, Agent, or Firm*—Rines and Rines

[57] ABSTRACT

A novel loop antenna containing a thin-walled ferrite box or other hollow; magnetic core structure of high permeability (considerably greater than 100), particularly useful for crossed loop antennas, and of optimal geometry and configuration for minimum volume, weight and space.

7 Claims, 4 Drawing Sheets

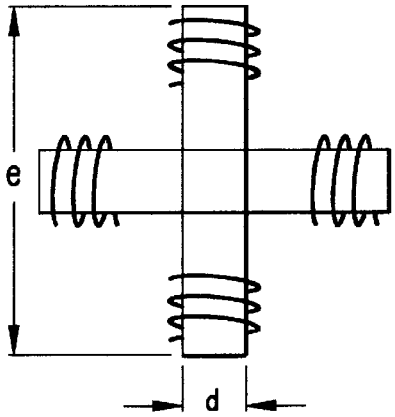
FIG. 1a
PRIOR ART
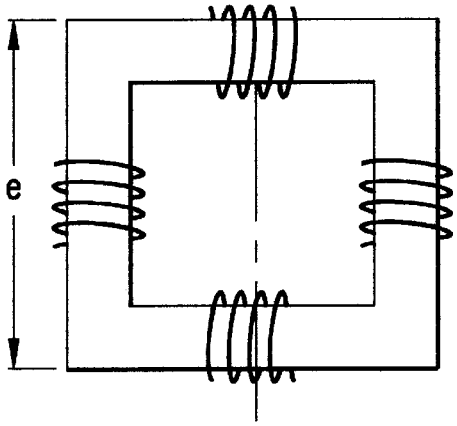
FIG. 1b
PRIOR ART
FIG. 2a
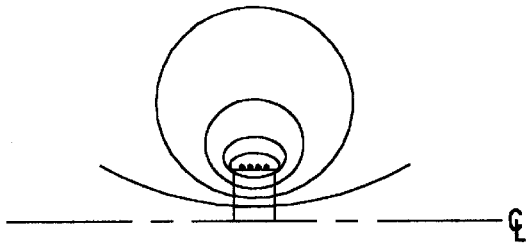
FIG. 2b
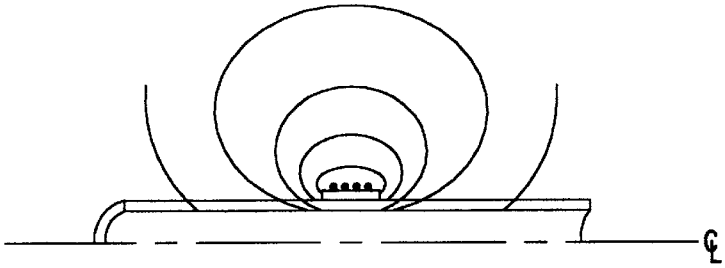
FIG. 2c
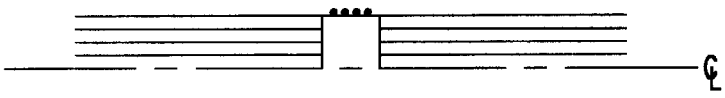
FIG. 2d
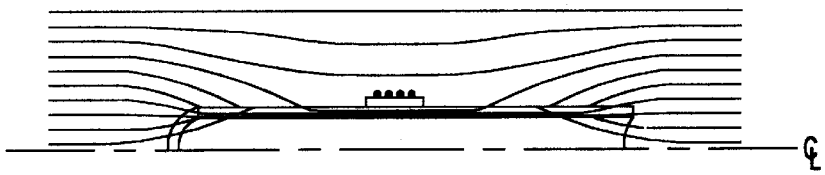

FERRITE CROSSED-LOOP ANTENNA OF OPTIMAL GEOMETRY AND CONSTRUCTION AND METHOD OF FORMING SAME

The present invention relates to loop antennas, particularly of the magnetic core type, and more specifically to pairs of orthogonally crossed ferrite loop antennas useful in position location determination from the reception thereby of radio signal transmissions such as navigation signals, including Loran C type navigation transmissions, GPS and other vehicle location applications and the like and methods of forming the same.

BACKGROUND

Loop antennas, including arrays involving orthogonally and otherwise relatively positioned or crossed loops have been used for many years in myriads of radio location and homing systems.

For purposes such as the above mentioned reception of radio navigation signals and the like, specifically Loran-C type transmissions, however, resort has been had to the use of linear antennas, such as whip antennas and the like, wherein, unlike loop antennas, all the received signals travel a single path into the receiver front end, with time difference measurements of signal arrival from two or more navigation transmitters unaffected by variations in receiver delays.

When using whip and similar antennas in applications such as vehicle tracking, signal losses caused by buildings in cities and other similar obstructions as well as E-field interference effects, as from the power lines and P-static effects, deleteriously plague the receiving system. Whip antennas, furthermore, for such usages, require considerable length and also the provision of a around plane, neither of which is desirable for vehicle mounting and unobtrusiveness.

Heretofore, while loop antennas obviate these particular requirements and, in addition, do not suffer E-field of P-static interference effects, they have not lent themselves to Loran-C and similar location signal tracking applications in view of their lack of omni-directivity, carrier phase inversion characteristic, the need for a pair of separate loops and associated band-pass filters and low noise amplifiers, and the inherently low signal strengths that may be involved.

An effective method of solving, the omni-directivity problem is described in copending application of Megapulse, Inc., the common assignee herewith, Ser. No. 08/695,361, filed Aug. 9, 1996, for "Method of and Apparatus For Position Location And Tracking Of A Vehicle Or The Like By The Reception At The Vehicle Of Pulsed Radio Navigation Signals As Of The Loran C Type And The Like, With an Autonomous Loop Antenna Receiver".

In my further copending application Ser. No. 733,296, filed Oct. 17, 1996, for "Magnetic Crossed-Loop Antenna", apparatus is described that addresses solving the problems arising from the use of two separate loops with associated circuitry and the low signal strength, enabling greatly improved reliability of reception of Loran C and similar radio navigation transmissions and without the necessity for long antennas or ground planes.

This is achieved by apparatus having, in combination with a pair of orthogonally crossed loop antennas, a corresponding pair of receiver channels for processing the radio signals received by the responsive antennas from radio transmitting stations; means for rapidly switching each loop antenna back and forth between its channel and the channel of the other loop antenna and for selecting the antenna channel with the stronger signals therein, and means for providing, optimum signal-to-noise ratio and sufficiently wide bandwidth in the receiving of the stronger signals in the selected antenna channel to ensure reception time delay stability.

The present invention is primarily directed to providing a ferrite crossed-loop antenna particularly suitable for the above purposes and of optimal performance geometry, compatible, also, with convenient packaging therewith of the receiver and display equipment, also involving a novel method of forming, such structures.

OBJECTS OF INVENTION

An object of the invention, accordingly, is to provide a new and improved ferrite magnetic loop antenna for the reception and tracking of radio navigation signals and the like, particularly, though not exclusively, as of the pulsed Loran-C radio navigation signals, that is superior to prior antenna systems heretofore so used, and is of substantially optimal performance geometry and construction.

A further object is to provide a novel high permeability hollow ferrite core crossed loop antenna of more general utility, as well.

An additional object is to provide a novel method of forming such structures with high permeability hollow-structure ferromagnetic cores inserted into the loop antenna.

Other and further objects will be described hereinafter and are more particularly delineated in the appended claims.

SUMMARY

In summary, from one of its important aspects, the invention embraces a loop antenna comprising windings internally containing a hollow magnetic core structure, the hollow core structure being of thin-walled ferromagnetic material of permeability much greater than 100.

From a broader viewpoint, the invention contemplates a method of minimizing the volume and weight of a crossed winding loop antenna, that comprises, inserting within the windings a thin-walled hollow magnetic core structure, and forming the walls of such core structure of ferromagnetic material of permeability much greater than 100.

Preferred and best mode designs and embodiments are hereinafter set forth in detail.

DRAWINGS

The invention will now be described in connection with the accompanying, drawings, FIGS. 1(*a*) and 1(*b*) of which illustrate prior art conventional crossed loop antennas;

FIGS. 2(*a*)–(*d*) are magnetic flux line patterns for such loop antennas (upper half), contrasting air and magnetic core flux patterns for self-inductance flux and external field flux as later described, FIGS. 3(*a*) and (*b*) are also magnetic flux line patterns of external field flux and self-inductance flux of magnetic core with a square-type configuration, FIG. 4 is a graph illustrative of the flux concentration in a short loop for a ferromagnetic core as a function of the ratio of major to minor axis, and FIG. 5 is an isometric view of the optimum design and construction of the crossed loop antenna of the invention, shown implemented in a thin-walled hollow box frame.

DESCRIPTION OF PREFERRED EMBODIMENT (S) OF INVENTION

It is now in order to describe the preferred construction, operation and resulting improved performance of the ferrite magnetic crossed loop antennas of the invention for such uses as to detect Loran-C radio navigation signals and the like, employing the "optimum" geometry of the very high permeability-hollow ferrite core crossed-loop antenna, underlying the present invention.

Conventional prior art crossed-loop antennas, as before described, are shown in FIGS. 1(*a*) and 1(*b*). Two solid ferrite rods forming a cross are shown in FIG. 1(*a*), and ferrite rods forming a square frame are shown in FIG. 1(*b*). The (*b*) geometry has almost twice the amount of ferrite as compared to (*a*), but it captures more flux lines, thus increasing the induced signals.

Figure 4:
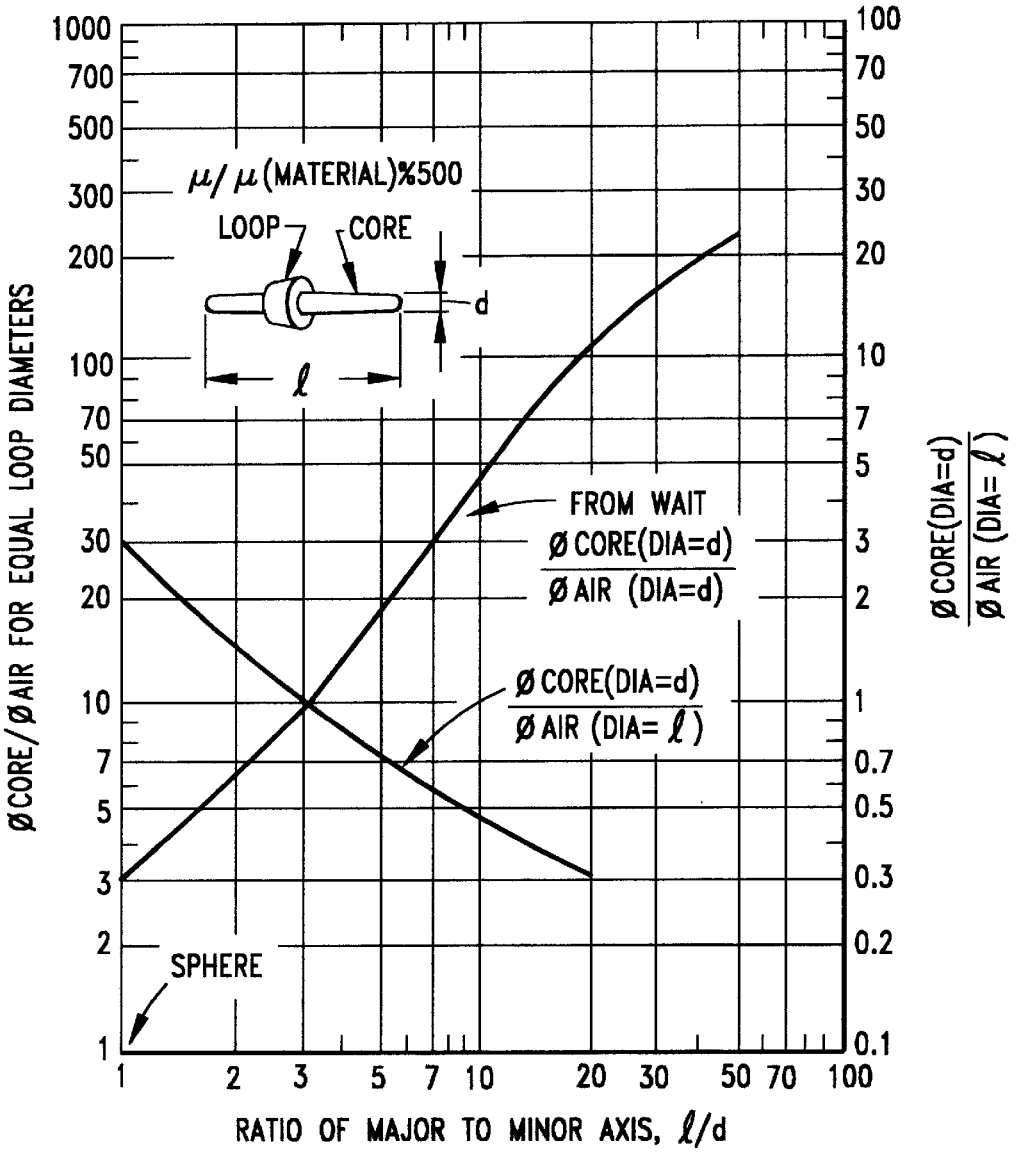

It has been shown, as presented in FIGS. 2(*a*)–(*d*), that the use of magnetic material increases flux lines in a single rod loop. The magnetic core material concentrates the flux lines through the winding thereby increasing the induced voltage and the inductance, FIGS. 2(*b*) and 2(*d*) respectively illustrating this increase for each of the self-inductance flux of the loop winding and the external field flux, over the respective air core loops of FIGS. 2(*a*) and 2(*c*). The increase in magnetic flux through a short-loop winding is presented in FIG. 4, reproduced from Watt A. D., "VLF Radio Engineering", Permagon Press, Oxford, 1967, showing flux concentration for a ferromagnetic core as a function of the ratio of major to minor axis of the loop. For a core material with relative permeability $\mu$ of 100 and a rod with a ratio of major to minor axis of 10, for example, the magnetic flux has increased by a factor of approximately 40. Further increase in the relative permeability ($\mu$) does not, however, cause any significant increase in magnetic flux (Pettengill, R. C. et al, "Receiving Antenna Design For Miniature Receivers, IEEE Transaction on Antenna and Propagation," July, 1977). The magnetic flux increase is referred to as $\mu_{core}$. The increase in the loop winding or coil inductance due to the magnetic core is referred to as $\mu_{coil}$. A 1 cm diameter rod 12 cm long with a short coil in the center, as an illustration, has a $\mu_{core}/\mu_{coil}$ of 10.

Figure 3A:
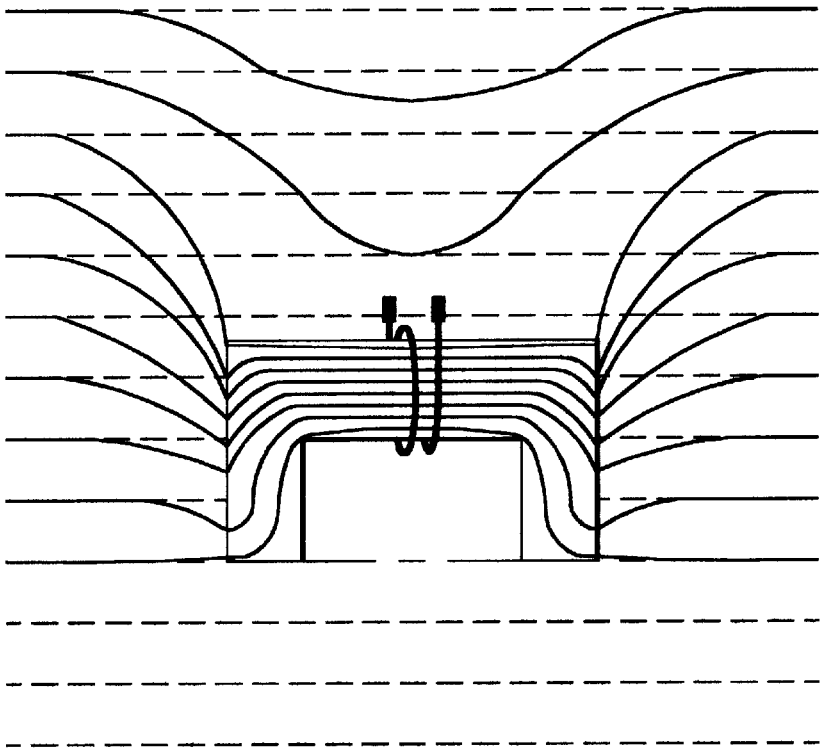
Figure 3B:
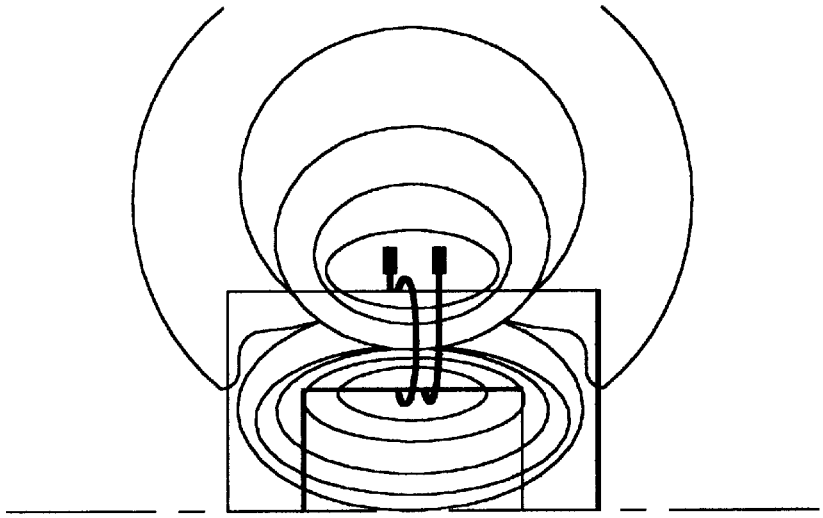

Magnetic flux lines for the square core of FIG. 1(*b*) are shown in FIGS. 3(*a*) and (*b*). More flux lines are captured than that of a single rod of length l, but the inductance has also increased. From experimental data it has been determined that for the same physical size, l×l, the square frame crossed-loop has better performance, though at the expense of more ferrite material and, consequently, increased weight.

Figure 5:
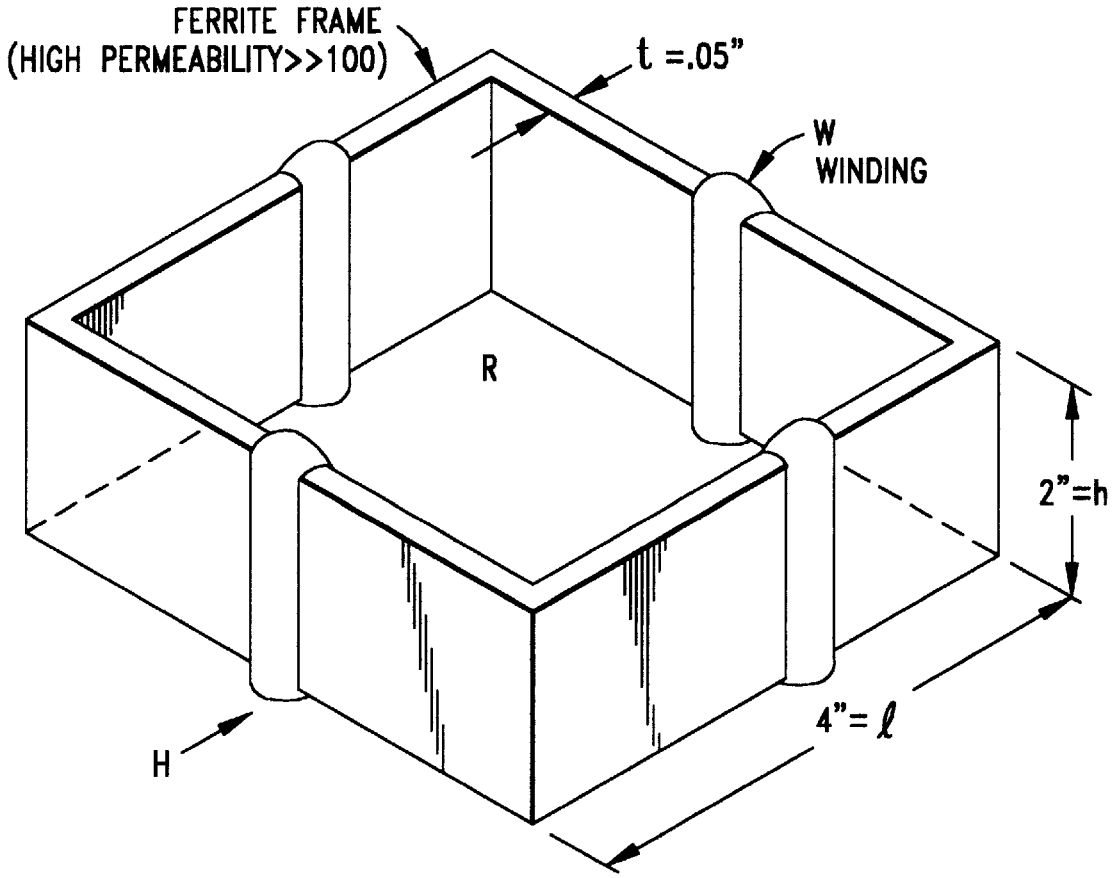

It has been pointed out, furthermore, that very little is gained by using, magnetic core material with a relative permeability, $\mu$ greater than 100. This property can be used to great advantage. A solid square block of magnetic material h meter high and 1 meter on the side has a magnetic conductivity (permeance) of $$P_1=\mu_2\mu_0 h_)$$

where $\mu_1$, is the relative permeability of the solid magnetic core material set equal to 100, $\mu_0$ is the permeability of free space, and h is the height of the structure. The permeance of a thin-walled, substantially square ferrite frame box, as shown in FIG. 5 of wall thickness t, height h and wall length l, is approximately:

$$P_2 \cong \mu_2\mu_0\frac{2ht}{1.5l}$$

where $\mu_2$ is the relative permeability of the thin-walled frame. By setting $P_1=P_2$, yields $$t \cong .75\frac{\mu_1}{\mu_2}l$$

If a magnetic material with a relative permeability of 6000 is used and the required permeability is 100, then such a box of wall thickness $$t = .75x\frac{100}{6000}l = .0125l,$$

has the same permeance as a larger and heavier solid block of magnetic material with a relative low permeability of 100. Thus, a reduction in volume and weight of $$\text{Volume reduction} = \frac{hl^2}{4hlt} = 20$$

has been achieved. The thin walled box ferrite frame of FIG. 5 is close to the optimum minimum volume and weight geometry for such a magnetic crossed-loop antenna. Synergistically to this novel kind of design and construction, all the electronics and displays of the Loran-C receiver or other apparatus connected to the crossed loops, schematically represented at R, can be housed in the space inside this hollow frame. The volume of such a receiver, for example, would be less than 32 cubic inches. Typical dimensions would be of the following approximate dimensions for the purposes of the invention:

l=4 inches; h=2 inches, t=0.05 inch.

While hollow square or rectangular thin-walled high permeability (of the order of thousands, as before explained) ferromagnetic core structures have been described, clearly other geometries, including hollow cylinders or tubes may also be employed. The invention, moreover, is also useful with single loop antennas.

Further modifications will also occur to those skilled in this art and such are considered to fall within the spirit and scope of the invention as defined in the appended claims.

What is claimed is:

1. A method of minimizing the volume and weight of a crossed winding loop antenna, that comprises, inserting within the windings a thin-walled hollow magnetic core structure, and forming the walls of such core structure of ferromagnetic material of permeability much greater than 100, and in which the thickness $\tau$ of the thin wall of the structure has substantially the following relationship with respect to its wall length $$r \cong 0.75\frac{\mu_1}{\mu_2}l,$$

where $\mu_1$ is the relative permeability of a solid magnetic core material set equal to 100, and $\mu_2$ is the relatively greater permeability of the ferromagnetic material of the thin wall.

2. A method as claimed in claim 1 and in which said permeability is of the order of thousands.

3. A method as claimed in claim 2 and in which said permeability is of the order of 6000.

4. A method as claimed in claim 2 and in which the hollow structure is in the form of a box frame with the windings about the walls.

5. A loop antenna comprising windings internally containing a hollow magnetic core structure, the hollow core structure being of thin-walled ferromagnetic material of permeability much greater than 100 and in which the loop antenna comprises a pair of orthogonally crossed windings wound about the thin walls of the hollow core structure, and in which the hollow core structure is in the form of a box frame, with the orthogonally crossed windings respectively wound about the opposing walls of the box frame, and in which the thinness $\tau$ of the box frame side 1 is adjusted substantially in accordance with the formula $$\tau \cong .75\frac{\mu_1}{\mu_2}l$$

where $\mu_1$ is 100 and $\mu_2$ is the relatively greater permeability of the thin-walled box frame.

6. A loop antenna as claimed in claim 5 and in which the greater permeability is of the order of thousands.

7. A loop antenna as claimed in claim 5 and in which the hollow of the core structure provides space for the containment of receiving apparatus for the antenna.

* * * * *